United States Patent [19]

Bowling

[11] 4,008,454

[45] Feb. 15, 1977

[54] DIFFERENTIAL EXPANSION ROD AND TUBE THERMOSTAT

[75] Inventor: Teamus Bowling, Fern Creek, Ky.

[73] Assignee: General Electric Company, Louisville, Ky.

[22] Filed: Nov. 4, 1975

[21] Appl. No.: 628,814

[52] U.S. Cl. ..... 337/386; 219/512; 236/102; 337/123; 337/394

[51] Int. Cl.[2] ..... H01H 37/46

[58] Field of Search ..... 219/412, 413, 512; 236/102; 337/123, 124, 125, 126, 131, 139, 383, 384, 386, 387, 388, 394; 73/363

[56] References Cited

UNITED STATES PATENTS

| | | | |
|---|---|---|---|
| 1,732,182 | 10/1929 | Denison | 337/383 |
| 2,640,896 | 6/1953 | Cataldo et al. | 337/383 |
| 3,121,158 | 2/1964 | Hurko | 219/397 |
| 3,130,354 | 4/1964 | Burling | 337/124 |
| 3,821,683 | 6/1974 | Bowling | 337/386 |

*Primary Examiner*—J D Miller
*Assistant Examiner*—Fred E. Bell
*Attorney, Agent, or Firm*—Richard L. Caslin; Francis H. Boos

[57] ABSTRACT

A differential expansion rod and tube thermostat wherein the material of the inner rod has a much lower coefficient of thermal expansion than does the material of the outer tube. The thermostat is adapted to be mounted through an opening in the wall of an oven cooking cavity. A certain amount of the tube remains outside the oven cooking cavity. The inner rod is adapted to lie within the oven cooking cavity. Joined to the inner rod is an extension strap of a material having a high linear coefficient of thermal expansion substantially the same as that of the outer tube. The longitudinal motion created by the difference in the rates of expansion between the outer tube and the combined inner rod and extension strap is transferred by a hinged amplifier lever to a switch mechanism which is calibrated to operate at a predetermined oven temperature.

7 Claims, 4 Drawing Figures

DIFFERENTIAL EXPANSION ROD AND TUBE THERMOSTAT

BACKGROUND OF THE INVENTION

1. Field of the Invention

This invention relates to differential expansion rod and tube thermostats, and particularly to one used as a single or multiple point temperature limit switch.

2. Description of the Prior Art

The present invention relates to a thermally-responsive switch assembly, and particularly to a double-point, thermally-responsive safety control switch assembly for a self-cleaning electric oven to serve as a redundant switch to remove power from the oven heating units in case of a failure of the main oven control thermostat, and further to interrupt a door interlock circuit to prevent the opening of the oven door when the oven ambient temperature is above a predetermined level, and further to effect the operation of an indicator lamp and a cooling fan to maintain safe operating temperatures of the outer surfaces of the oven cabinet.

This invention is related to the art of pyrolytic, self-cleaning ovens which utilize a high temperature method of cleaning the interior walls of the oven cooking cavity of food soils and grease spatter by raising the temperature of the walls into a heat cleaning temperature range above about 750° F. At this high temperature, the food soils are transformed into gaseous degradation products which are then oxidized and finally discharged from the oven cavity. The details of this method and of a preferred embodiment of an oven design in which it may be carried out, are fully disclosed in U.S. Pat. No. 3,121,158 of Bohdan Hurko, which is assigned to the same assignee as the present invention.

Thermally-responsive or thermostatic switches are commonly used in domestic appliances, such as baking and broiling ovens. Perhaps one of the most common types used is the hydraulic thermostat which is essentially a hydraulic-filled bellows or diaphragm assembly that converts volumetric expansion or contraction thereof into rectilinear motion acting upon a switch mechanism. Others are of the differential thermal expansion type such as a rod and tube thermostat as is shown in my earlier U.S. Pat. No. 3,821,683, which is also assigned to the present assignee. The thermostat of my earlier patent serves to translate a rise in oven temperature that is sensed by the rod and tube assembly into rectilinear motion which is translated through a ball and socket joint to a motion amplifier lever that in turn effects the opening and closing of a pair of switch members. These switch members are shown as slow make and break switches.

The thermal switch of my earlier patent operated in a control circuit for a self-cleaning oven, the same as used with the present invention; firstly, to insure that during the baking or broiling operations the oven air temperature does not rise above a safe temperature; for example, in the 600° F – 650° F. range in the event of a failure of one of the temperature control components; secondly, of insuring that the user may not unlatch the oven door during a self-cleaning oven cycle unless the oven ambient temperature returns below approximately 600° F; thirdly, of insuring that the outside wall temperatures of the oven cabinet do not reach certain unsafe temperatures, and to effect this, at approximately 600° F. oven ambient temperature, a cooling fan is energized to force room air to be circulated between the inner and outer walls of the oven structure.

The principal object of the present invention is to provide a thermally-responsive switch assembly using a rod and tube differential expansion thermostat which has ambient temperature compensation and also compensation for the thermal lag of this thermostat on the early heating cycles to prevent overshoot of the calibration temperature.

A further object of the present invention is to provide a rod and tube thermostat of the class described where the inner rod has an extension strap which is essentially outside the area with the temperature that is to be controlled, and this strap has thermal expansion characteristics similar to that of the tube.

A further object of the present invention is to provide the thermostat assembly of the class described wherein the extension strap couples the inner rod to an amplifier lever which serves as a switch actuator means.

A further object of the present invention is to provide a thermally-responsive switch assembly of the class described wherein the amplifier lever is provided with a hinging means that maintains a given spatial relationship between the base of the thermostat and the amplifier lever.

A further object of the present invention is to provide a thermally-responsive switch assembly of the class described combining a snap-action switch mechanism with the ambient temperature compensated rod and tube thermostat.

SUMMARY OF THE INVENTION

The present invention, in accordance with one form thereof, relates to a thermally-responsive switch assembly comprising a base, a housing attached to the base, and a plurality of switch means attached to the housing. Secured to the base is a differential expansion thermostat of the rod and tube type where the material of the inner rod has a much lower coefficient of thermal expansion than that of the material of the outer tube. The thermostat is adapted to project into an oven cooking cavity to sense the oven interior temperature. A predetermined length of the tube extends on the outside of the oven to be free of direct exposure to the oven ambient temperature. The inner rod of the thermostat is exposed to the oven ambient temperature. An extension strap is fastened to the end of the inner rod, and the strap is of a material that has substantially the same high coefficient of thermal expansion as that of the outer tube. The extension strap couples the inner rod to an amplifier lever that is hingedly mounted to the base. This amplifier lever serves as the actuating means for a snap-acting switch mechanism.

BRIEF DESCRIPTION OF THE DRAWINGS

This invention will be better understood from the following description taken in conjunction with the accompanying drawings, and its scope will be pointed out in the appended claims.

DESCRIPTION OF THE PREFERRED EMBODIMENT

Figure 2:
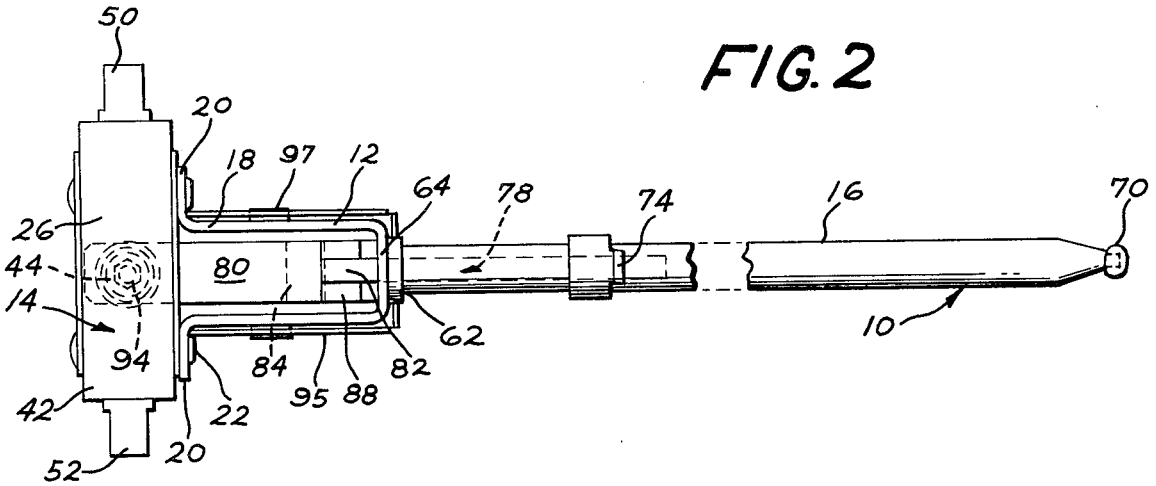
FIG. 2 is a top plan view of the thermally-responsive switch assembly of FIG. 1.
Figure 1:
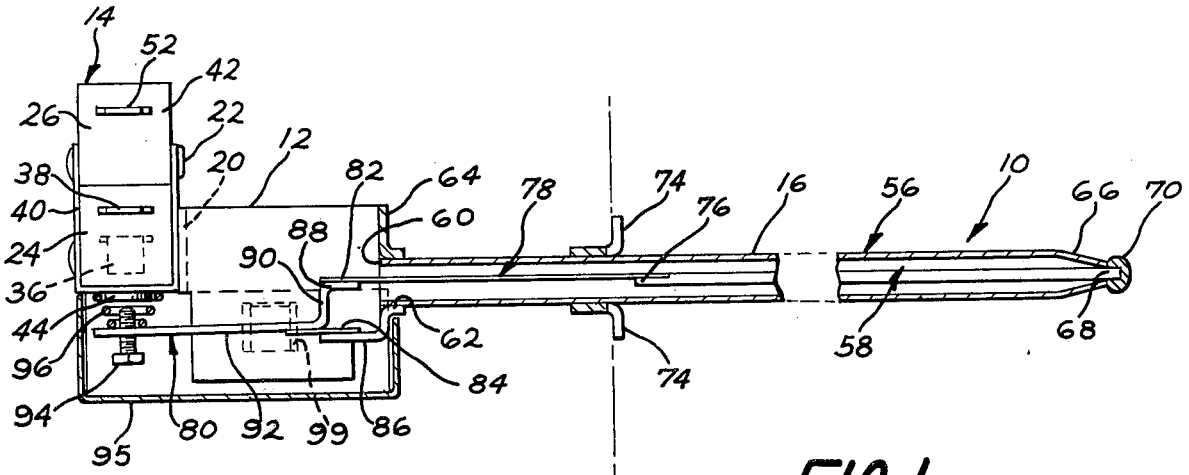
FIG. 1 is a side, cross-sectional, elevational view of a thermally-responsive switch assembly according to the present invention.
Figure 3:
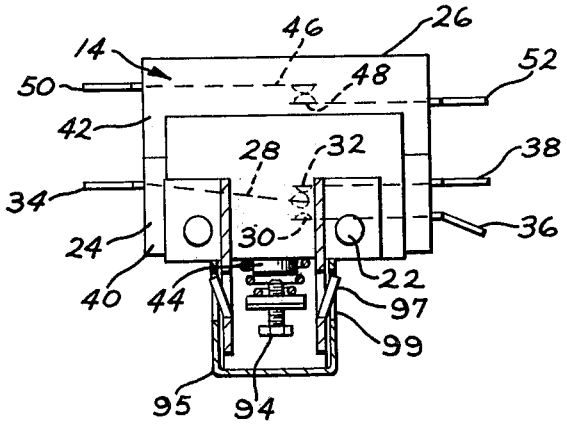
FIG. 3 is a left end view of the thermally-responsive switch assembly of FIGS. 1 and 2 showing diagrammatically the snap-acting switch mechanism which is acted upon by the rod and tube thermostat of the present invention.

Turning now to a consideration of the drawings and in particular to FIG. 1, there is shown a thermally-responsive control switch assembly 10, as for use with a self-cleaning electric oven. This switch assembly 10 is a differential expansion thermostat of the rod and tube type comprising three main elements, namely, a base 12, a switch housing 14, and a rod and tube temperature sensor 16. The base 12 is a sheet metal bracket that has the form of a hat-shaped member in top plan view, as seen in FIG. 2, with a generally U-shaped body 18 and a pair of oppositely directed flanges 20 to which the switch housing 14 is attached by means of rivets 22. The switch housing 14 is actually a gang or stack of two miniature switch modules 24 and 26. The internal nature of the switch modules 24 and 26 is shown diagrammatically in the end view of FIG. 3.

Switch module 24 is a single pole, double-throw switch having a movable contact blade 28 and a pair of fixed switch contacts 30 and 32. The movable contact blade 28 has an external terminal 34, while the switch contacts 30 and 32 have terminals 36 and 38 respectively. Of course, each switch module 24 and 26 has a housing 40 and 42 respectively of electrically insulating material such as a phenolic or the like. Each switch module 24 and 26 is a snap-acting miniature switch which requires very little force on the switch button 44, that is shown at the underside of the lower switch module 24, in order to change the make or break switch setting.

The upper switch module 26 is a single-pole, single-throw switch having one movable contact blade 46 and one fixed switch contact 48. Each contact 46 and 48 has a switch terminal 50 and 52 respectively. These two switch modules 24 and 26 are stacked together, and the switch button 44 is adapted to bear against the nearest movable contact blade 28. There would be a connector (not shown) between blade 28 and blade 46 so that they move in unison. Such switches 24 and 26 require a small operating force and have a very small stroke between the make and break positions. The amplitude of the oven temperature cycles relates directly to the stroke required to make and break the contacts of the switches.

The rod and tube temperature sensor 16 is best illustrated in FIG. 1, and it comprises an elongated outer tube 56 and an inner rod 58. One end 60 of the tube 56 is permanently fastened in an opening 62 in the U-bend 64 of the base 12 that is opposite the pair of flanges 20 of the base. This end 60 of the tube is open. The tube is generally of uniform transverse cross-section except at the free end 66 of the tube which is tapered down to engage the end 68 of the inner rod 58. The end 68 of the inner rod actually extends outwardly of the tapered end 66 of the tube and then a weld bead 70 is formed at the tip to join the inner rod 58 to the tube 56 and make a rigid connection between the parts.

The tube 56 and the inner rod 58 are made of dissimilar metals. The material of the inner rod 58 has a much lower coefficient of thermal expansion than that of the material of the outer tube 66. For example, the inner rod is of Rodar or Invar No. 39 material which is available from the Wilbur D. Driver Company of Teterboro, New Jersey. The outer tube 66 is formed of an Incoloy 840 or 321 stainless steel that are available from the International Nickel Co.

This switch assembly 10 is adapted to be mounted in a conventional manner to a wall of an oven liner (not shown) that cooperates with an access door to form an oven cooking cavity. Intermediate the ends of the tube 56 are a pair of mounting ears 74 which are welded to the tube and are diametrically opposite each other. The free end of the tubing 56 is adapted to be inserted through a close fitting opening (not shown) in the oven liner, usually in the back wall thereof, near the top edge thereof. Such an opening would have diametrically opposed notches which would permit the mounting ears 74 to slip through the opening. Then the switch assembly 10 is rotated about its longitudinal axis a slight amount so that the mounting ears are out of alignment with the notches and then pressure is applied to hold the mounting ears 74 against the inner side of the back wall of the oven liner. Finally a mounting ring (not shown) would slip over the free end of the tube 56 and would be fastened by sheet metal screws that thread into openings in the back wall such that the mounting ring sandwiches the mounting ears 74 against the back wall of the oven liner. Thus the length of the tube 56 that is measured between its free end at 70 and the mounting ears 74 is the amount of material that lies within the oven cooking cavity whose temperature is to be sensed and controlled. Notice that the inner rod 58 stops short of the supported end 60 of the outer tube 56, in that it terminates at 76 in the vicinity of the mounting ears 74. Joined to the inner rod 58 is an extension strap 78 that is of a material with a high coefficient of thermal expansion that is substantially the same as that of the outer tube 56. The relative length of the inner rod to the length of the extension strap in a given length of outer tube taken in conjunction with the amount of the tube exposed to the oven ambient temperature, determines the degree of early heating cycle variance from the calibration temperature. This variance on early cooking cycles is caused by the thermal mass of the thermostat, and the oven ambient temperature gradients.

Joined to the extension strap 78 is an amplifier lever 80, as at 82. This amplifier lever 80 is provided with a hinge means in the form of a thin, flexible, metal strip 84 that is fastened between the base 12 and the amplifier lever 80, as shown in FIG. 1. The U-bend 64 of the base 12 is formed with a horizontal tab 86. The amplifier lever 80 is an offset angular member in side elevational view as seen in FIG. 1, having a horizontal tab 88 that is adapted to be connected to the extension strap 78 as at 82. The amplifier lever 80 also has an offset arm 90 that is generally perpendicular to the tab 88. Finally the lever has a horizontal elongated arm 92 which serves as the actuator means for the switch button 44. Notice that the tab 86 of the base 12 terminates adjacent the apex of the amplifier lever 80 formed between the offset arm 90 and the elongated arm 92. The hinge strip 84 is generally a flat strip of metal that is welded to the top surface of the tab 86 and to the underside of the elongated arm 92.

Accordingly, the amplifier lever 80 serves as a bell-crank lever, where the offset arm 90 is one arm of the bellcrank, the elongated arm 92 is the second arm of the bellcrank, and the hinge strip 84 serves as the fulcrum at the apex of the offset arm 90 and the elongated arm 92.

The free end of the amplifier lever 90 is provided with a calibration screw 94 that is threaded through the elongated arm 92 and is adapted to bear against the switch button 44. A helical compression spring 96 is interposed between the switch housing 40 and the elongated arm 92 of the amplifier lever 80 to exert a given force on the amplifier lever 80 and hence on the combined inner rod 58 and extension strap 78 of the rod and tube temperature sensor 16, to reduce the spring rate of the thermostat. A metal cap 95 slips over the lower portion of the base 12 and encompasses the amplifier lever 80 with its calibration screw 94 to serve as a protector for this mechanism and the critical setting of the calibration screw. Lanced tabs 97 are formed in the base to engage openings 99 in the cap and holding the cap in place. In some installations the switch assembly 10 has been mounted in an inverted position from that shown in FIG. 1, so the cap 95 is at the top rather than at the bottom as shown.

The principle of operation of this rod and tube thermostat 10 is that it utilizes the difference in expansion of two dissimilar metals, which are exposed to the oven ambient temperature. The outer tube 56 is adapted to be secured to one wall of an oven liner in the vicinity of the mounting ears 74, thereby leaving a predetermined length of the rod and tube exposed to the oven ambient temperature. As the oven temperature increases, the length of the tube increases at a greater rate than the rate of the combined length of the inner rod 58 and the extension strap 78. This differential in expansion characteristics causes the amplifier lever 80 to pivot about the base with the flexible metal strip 84 as a fulcrum. By means of the proper adjustment of the calibration screw 84, it is possible to effect the operation of the snap-acting switches 24 and 26 at a predetermined degree of oven temperature.

The function of the extension strap 78 is to compensate for ambient temperature variations outside the oven cavity, as well as to compensate for the early heating cycle variance from the calibration temperature due to the thermal mass of the thermostat and the oven ambient temperature gradients.

Also, it should be understood by those skilled in this art that the metal hinge strip 84 is of such a reliable nature that it eliminates conventional bearing points that might otherwise cause drift and calibration problems.

Figure 4:
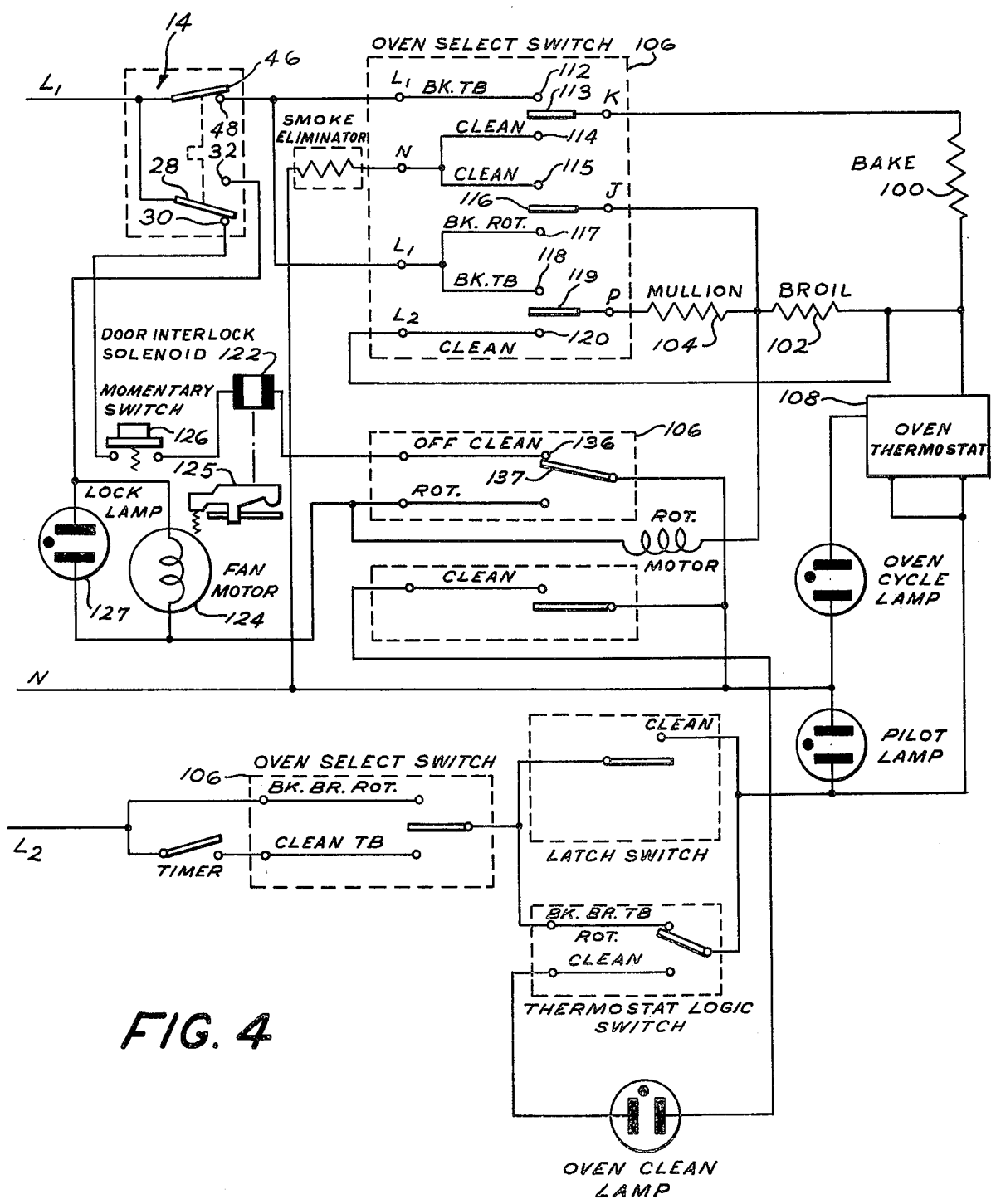
FIG. 4 is a schematic representation of a power and control circuit useful for a self-cleaning electric oven embodying the thermal-responsive switch assembly of the present invention.

The thermally-responsive switch assembly 10 is designed to be used as a control component for a self-cleaning electric oven whose power and control circuits are illustrated in the schematic diagram of FIG. 4. The oven is furnished with one three-wire Edison source of power; nominally of 120/240 volts branch circuit, single phase, 60 Hz, AC which is usually available in the average residence having adequate wiring. This voltage source is fed to the oven with a three wire power cable having a pair of line wires $L_1$ and $L_2$ with a voltage of 240 volts therebetween, and a grounded neutral conductor N, for supplying the electrical load of the oven. There would be 120 volts measured between either line wire $L_1$ and $L_2$ and the neutral conductor N. This electrical load is characterized by three heating elements; a baking element 100, a broiling element 102, and a mullion heater 104. The bake element 100 is usually located adjacent the bottom wall of the oven liner, the broil element 102 is usually located adjacent the top wall of the oven liner and the mullion heater 104 is usually wrapped around the outside of the oven liner adjacent the front door opening for replacing the heat lost through the door and around the door opening during a high-temperature, heat-cleaning or pyrolytic cycle. These heating elements 100, 102 and 104 are arranged in circuit in combination with an oven selector switch 106 for setting up different combinations of heating elements at different voltages to obtain a variety of heating rates. A manually settable oven thermostat 108 is also provided for controlling the temperature within the oven cooking cavity at preselected temperatures during baking and broiling operations, as well as a maximum temperature during the pyrolytic, self-cleaning oven cycle. Such an oven thermostat 108 is arranged serially with the heating elements 100, 102 and 104 for opening and closing the power circuit to the heating elements as a function of the oven temperature which relation to the temperature predetermined or preset by the adjustment of the thermostat 108.

The oven selector switch 106 is provided with a series of line input terminals denoted as $L_1$, N, $L_1$, and $L_2$, as well as a series of load terminals denoted as K, J, and P. This selector switch 106 is also provided with a plurality of switch contacts 112 through 120. These switch contacts are labeled with a particular cooking or cleaning operation that is involved when such contacts are closed. For example, during a BAKING or a TIME BAKING operation, contacts 112 and 113, 118 and 119 are closed. During a BROILING or ROTISSERIE operation, contacts 116 and 117 are closed. During a CLEANING cycle, contacts 113 and 114, 115 and 116, 119 and 120 are closed.

The BAKING circuit has the bake element 100 operating at full wattage across lines $L_1$ and $L_2$ at 240 volts through the switch 26 and its normally closed switch contacts 46 and 48, through the line terminal $L_1$ of the oven selector switch 106, and through switch contacts 112 and 113, the load terminal K, and through the bake element 100 and back to $L_2$. During the BAKING cycle, the other two heating elements 102 and 104 are also energized. They are in a series circuit connected back to first switch 26, through switch contacts 46 and 48, by means of oven selector switch 106, line terminals $L_1$ through oven switch contact 118 and 119 to load terminal P, and then through the mullion heater 104 and the BROIL element 102, and back to $L_2$.

In the BROILING or ROTISSERIE circuit only the broil element 102 is energized, and it is across lines $L_1$ and $L_2$ through the first switch 26 and its contacts 46 and 48 to oven selector switch terminal $L_1$, through switch contacts 117 and 116 to load terminal J, and then through the BROIL element 102, and back to line $L_2$.

Should there be a component failure during a cooking operation of BAKING, TIME BAKING, BROILING, or ROTISSERIE, and should the oven temperature rise above the preset temperature of the oven thermostat 108 and reach an oven temperature above about 600° F. and then switch 26 of the thermally-responsive switch 10 would be operated by the rod and tube temperature sensor 16 to open the circuit through switch contacts 46 and 48, thereby de-energizing the heating elements and preventing a runaway temperature condition. Thus, first switch 26 of the thermal switch assembly 10 serves as an oven-temperature limit control when the oven is in any normal cooking operation. In the event of a malfunction of the primary temperature control 108, any hazard due to overheating of the oven during normal cooking operations is eliminated.

The second switch 24 of the thermally-responsive switch assembly 10 is arranged to be in an operating circuit only during the self-cleaning mode of operation. During the CLEANING cycle, the three heating elements 100, 102 and 104 are connected in parallel at half voltage across lines $L_2$ and neutral conductor N in order to obtain a heating rate somewhat lower than the heating rate during a normal BAKING operation. At temperatures below about 550° F., normally closed switch contacts 28 and 30 allow actuation of an interlock solenoid 122 by actuation of a momentary switch 126 for operating the latching mechanism (not shown) of the oven door. At temperatures above 550° F., contacts 28 and 32 are closed to provide the power to the cooling fan motor 124 which causes air to be circulated between the walls of the oven liner and the outer walls of the oven cabinet so as to keep the temperature of these outer walls below a predetermined amount. When the switch contacts 28 and 32 are closed the circuit through the switch contacts 28 and 30 is opened thereby de-energizing the solenoid circuit so that it is no longer possible to operate the door latch until the oven ambient temperature drops below about 550° F. The circuit through switch contacts 28 and 32 also operates the oven lock lamp 127 to indicate to the user that the oven is in a locked condition and the oven door may not be opened. For a more thorough discussion of the oven door latching system in which the present invention is used, reference is made to U.S. Pat. No. 3,484,858-Bowling et al, assigned to the same assignee as the present invention.

In order to set up the CLEANING circuit there are several preliminary steps that must be performed. It is imperative that the oven door first be closed and then locked before the self-cleaning cycle is initiated. It is also imperative that the oven door remain closed and incapable of being operated or opened while the oven temperature is above normal cooking temperatures of about 550° F. A door latch mechanism (not shown) is actuated by a handle and is provided with an automatic locking means in the form of a spring-biased pivoted hook member 125 which locks the door latching mechanism in both its open and closed positions. In other words, the locking means must be disengaged before the oven door handle may be shifted. This is accomplished by connecting a solenoid 122 across line $L_1$ and neutral conductor N to the second switch 24, contacts 28 and 30, then through a momentary switch 126, then through the solenoid 122 to switch contact 136 and 137 of the oven selector switch 106. Thus at temperatures below the operating temperature of the temperature limit switch 10, that is, below 550° F., it is possible to actuate the oven door lock handle by closing the momentary switch 126, thereby energizing solenoid 122 which picks up the automatic locking device 125 and releases the door latch mechanism. However, at temperatures above normal cooking temperatures, that it, above 600° F., contacts 28 and 30 will be opened thereby disabling the solenoid circuit and preventing access to the oven in the self-cleaning oven cycle. It is not thought necessary to go into any further detail of the power and control circuit since the present invention is centered around the thermally-responsive switch assembly 10 rather than in the overall oven circuit in which it is being used.

Modifications of this invention will occur to those skilled in this art, therefore, it is to be understood that this invention is not limited to the particular embodiment disclosed but that it is intended to cover all modifications which are within the true spirit and scope of this invention as claimed.

What is claimed is:

1. A thermally-responsive switch assembly comprising:

a base;

a housing attached to said base;

switch means attached to said housing;

a differential expansion thermostat having an outer tube secured to said base and an inner rod secured to the tube adjacent the free end thereof, the rod being formed of a material having a much lower coefficient of thermal expansion than that of the material of the outer tube, the thermostat being adapted to project into an oven cooking cavity to sense the oven interior temperature, a mounting means for supporting the thermostat through a wall forming the oven cooking cavity so as to leave a predetermined length of the tube on the outside of the oven to be free of exposure to the oven ambient temperature;

the inner rod of the thermostat being mostly exposed to the oven ambient temperature;

an extension strap joined to the end of the inner rod and being of a material with a high coefficient of thermal expansion that is substantially the same as that of the outer tube;

an amplifier lever joined to the extension strap; and a hinge means provided between the amplifier lever and the base so that movement of the combined inner rod and extension strap causes movement of the free end of the amplifier lever for operating the said switch means.

2. The invention of claim 1 wherein the free end of the amplifier lever includes calibration means for obtaining a predetermined temperature setting for the operation of the switch means.

3. The invention of claim 1 wherein the inner rod is disposed mostly within the portion of the outer tube that is adapted to be within the oven cooking cavity, and the extension strap is adapted to extend mostly outside the oven cooking cavity.

4. The invention of claim 1 wherein the hinge means is a flexible metal strip that maintains a given spatial relationship between the base and the amplifier lever.

5. The invention of claim 1 wherein the amplifier lever is a bellcrank having a short arm and a long arm with the hinge means acting at the fulcrum of the bellcrank, the short arm being joined to the extension strap and the long arm adapted to engage and operate the switch means.

6. The invention of claim 1 wherein the switch means has a snap action and the thermostat functions to prevent early cycle variance from the calibration temperature as well as compensate for the effect of the exterior oven ambient temperature variations on the thermostat.

7. The invention as recited in claim 1 wherein the extension strap is mostly outside the mounting means and the inner rod is mostly outside the mounting means;

the hinge means being a flexible metal strip;
the amplifier lever being a bellcrank with the hinge means acting at the fulcrum of the bellcrank;
the free end of the amplifier lever including a calibration screw for engaging and operating the switch means;
and the switch means has a snap action.

* * * * *